US007046143B2

(12) United States Patent
Al-Khateeb

(10) Patent No.: US 7,046,143 B2
(45) Date of Patent: May 16, 2006

(54) IMAGE DATA ANALYSIS SECURITY CAMERA

(76) Inventor: Osama Othman Mostaeen Al-Khateeb, P.O. Box 2145, Safat 13022 (KW)

( * ) Notice: Subject to any disclaimer, the term of this patent is extended or adjusted under 35 U.S.C. 154(b) by 114 days.

(21) Appl. No.: 10/753,813

(22) Filed: Jan. 8, 2004

(65) Prior Publication Data

US 2005/0156737 A1 Jul. 21, 2005

(51) Int. Cl.
*G08B 13/00* (2006.01)

(52) U.S. Cl. ..... 340/541; 340/5.53; 340/5.83; 348/152; 348/161

(58) Field of Classification Search ..... 340/541, 340/5.1, 5.2, 5.3, 5.53, 5.8, 5.83; 348/143, 348/152, 153, 156, 161; 382/115, 118
See application file for complete search history.

(56) References Cited

U.S. PATENT DOCUMENTS

| | | | | |
|---|---|---|---|---|
| 4,408,224 | A * | 10/1983 | Yoshida | 348/155 |
| 4,455,550 | A * | 6/1984 | Iguchi | 340/525 |
| 5,151,945 | A * | 9/1992 | Lee et al. | 382/103 |
| 5,731,832 | A * | 3/1998 | Ng | 348/155 |
| 6,819,867 | B1 * | 11/2004 | Mayer et al. | 396/56 |
| 6,909,458 | B1 * | 6/2005 | Suzuki et al. | 348/211.8 |

* cited by examiner

*Primary Examiner*—Brent A. Swarthout
(74) *Attorney, Agent, or Firm*—Michael I Kroll

(57) ABSTRACT

An image data analysis security camera having internal logic circuits and remote user controls. The image data analysis security camera samples an initial image and compares subsequent images thereto, if a deviation between the two images is detected the image data analysis camera will initiate a remote alarm. The image data analysis security camera may also be provided with wireless communication capabilities and an internal battery thereby enabling the user to move the camera to another location quickly and easily.

18 Claims, 15 Drawing Sheets

IMAGE DATA ANALYSIS SECURITY CAMERA

BACKGROUND OF THE INVENTION

1. Field of the Invention

The present invention relates generally to security camera devices and, more specifically, to a self contained image data analysis security camera containing logic circuits to capture an initial image and a processor to compare subsequent images thereto. The images are transmitted to a central station allowing the field of view to be displayed on a monitor and recorded by a VCR or other suitable recording device. The present invention may be used for conventional monitoring wherein streaming video is sent directly to the monitor and recording device without image comparison. When in security mode the processor in the camera continually compares incoming subsequent images with the initial captured image stored in the memory until a discrepancy between the two images is detected and initiates an alarm mode. A discrepancy between the initial captured image and an incoming subsequent image initiates an alarm mode wherein an audible and/or visual alarm is activated at the central station and/or other desired location. The alarm mode remains in effect until the operator depresses a memory control switch which then clears the memory and captures the current image which is then used for comparison to any subsequent images for the duration of the security mode or until another discrepancy is detected by the processor resulting in another alarm condition.

The present invention includes an alarm sensitivity adjustment means to the processor to allow the operator to determine how much of a discrepancy between the captured image and the stored image is required to initiate the alarm mode. For instance, a high sensitivity setting may initiate the alarm mode due to the movement of a fly or other small object, whereas the introduction of a cat into the field of view during a medium sensitivity setting would be required to have the processor set off the alarm and a low sensitivity setting would require the introduction or movement of a larger object such as human to initiate an alarm.

Additional options to the present invention include a power loss detection battery backup and connection less transmission of image signals, remote control switches, alarms and other appropriate remote components.

2. Description of the Prior Art

There are other surveillance cameras for security systems, while these surveillance cameras may be suitable for the purposes for which they were designed, they would not be as suitable for the purposes of the present invention, as hereinafter described.

SUMMARY OF THE PRESENT INVENTION

A primary object of the present invention is to provide a surveillance camera having data analysis capabilities for capturing an image and comparing subsequent incoming images thereto to detect activity in the targeted area.

Another object of the present invention is to provide an image data analysis security camera wherein a processor and logic circuits are integral therewith.

Still another object of the present invention is to provide an image data analysis security camera that may be used with existing security monitors and alarms.

Yet still another object of the present invention is to provide an image data analysis security camera that may be used with just an alarm to alert the necessary personnel that an alarm condition exists in the secured area.

Yet another object of the present invention is to provide an image data analysis security camera that will overcome human error of negligence of security personnel.

Another object of the present invention is to provide an image data analysis security camera that can easily and cost-effectively be installed and integrated with existing hardware.

Still another object of the present invention is to provide an image data analysis security camera that is simple and easy to use.

Still yet another object of the present invention is to provide an image data analysis security camera that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
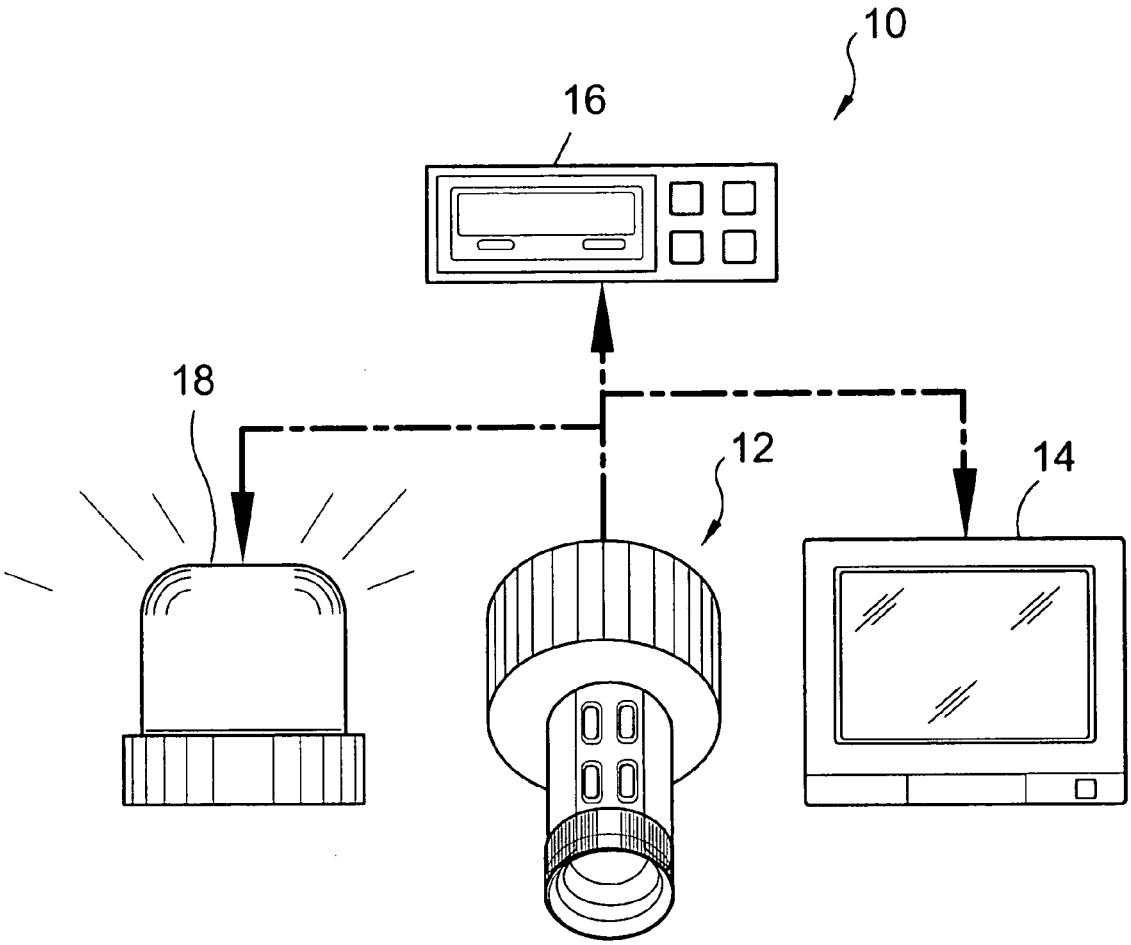
FIG. 1 is an illustrative view of the present invention.

Turning now descriptively to the drawings, in which similar reference characters denote similar elements throughout the several views, the figures illustrate the Image Data Analysis Security Camera System of the present invention. With regard to the reference numerals used, the following numbering is used throughout the various drawing figures.

10 Image Data Analysis Security Camera System
12 image data analysis security camera
14 monitor
16 recording device
18 alarm
20 remote monitoring station
24 lens
26 light sensitive electronic chip
28 processor
30 memory
32 memory control circuit
34 image circuit
36 user controls
38 control switches
40 variable alarm sensitivity switch
42 power source
44 memory control switch
46 power and monitor switch
48 image capture switch
50 security mode switch
52 first electrical connection
54 second electrical connection
56 third electrical connection
58 fourth electrical connection
60 fifth electrical connection
62 sixth electrical connection
63 control connection
64 first signal connection
66 second signal connection
68 third signal connection
70 fourth signal connection
72 fifth signal connection
74 sixth signal connection
76 seventh signal connection
78 eighth signal connection
80 ninth signal connection
82 tenth signal connection
84 eleventh signal connection
86 camera receiver
88 monitor station receiver
90 camera transmitter
92 user control transmitter
94 battery
96 computer
98 computer interface
100 operator
102 intruder

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention. The image data analysis security camera system 10 is a security system designed to monitor and record streaming video in real time with an incorporated alarm mode that takes a first image with all sampled subsequent images compared thereto, whereby, any deviance found in subsequent images initiates an alarm condition. The system is comprised of at least one image data analysis security camera 12 in communication with a monitor 14, recording device 16 and audible and/or visual alarm device 18 with logic circuits integral with the camera 12. The system 10 can be engaged in either a monitor mode or a security mode. In the monitor mode the camera images are viewed on the monitor 14 as well as being recorded on the recording device 16. When the security mode is initiated, a first image is obtained and stored in memory with the real time streaming video images sampled, based on the processor capabilities, and compared to the first image. If no deviation from the first image is detected another image is captured with the process continuing while the system is in security mode. When a deviation in image comparison occurs, an alarm 18 condition is initiated. Real time video monitoring and recording continue throughout security mode.

Figure 2:
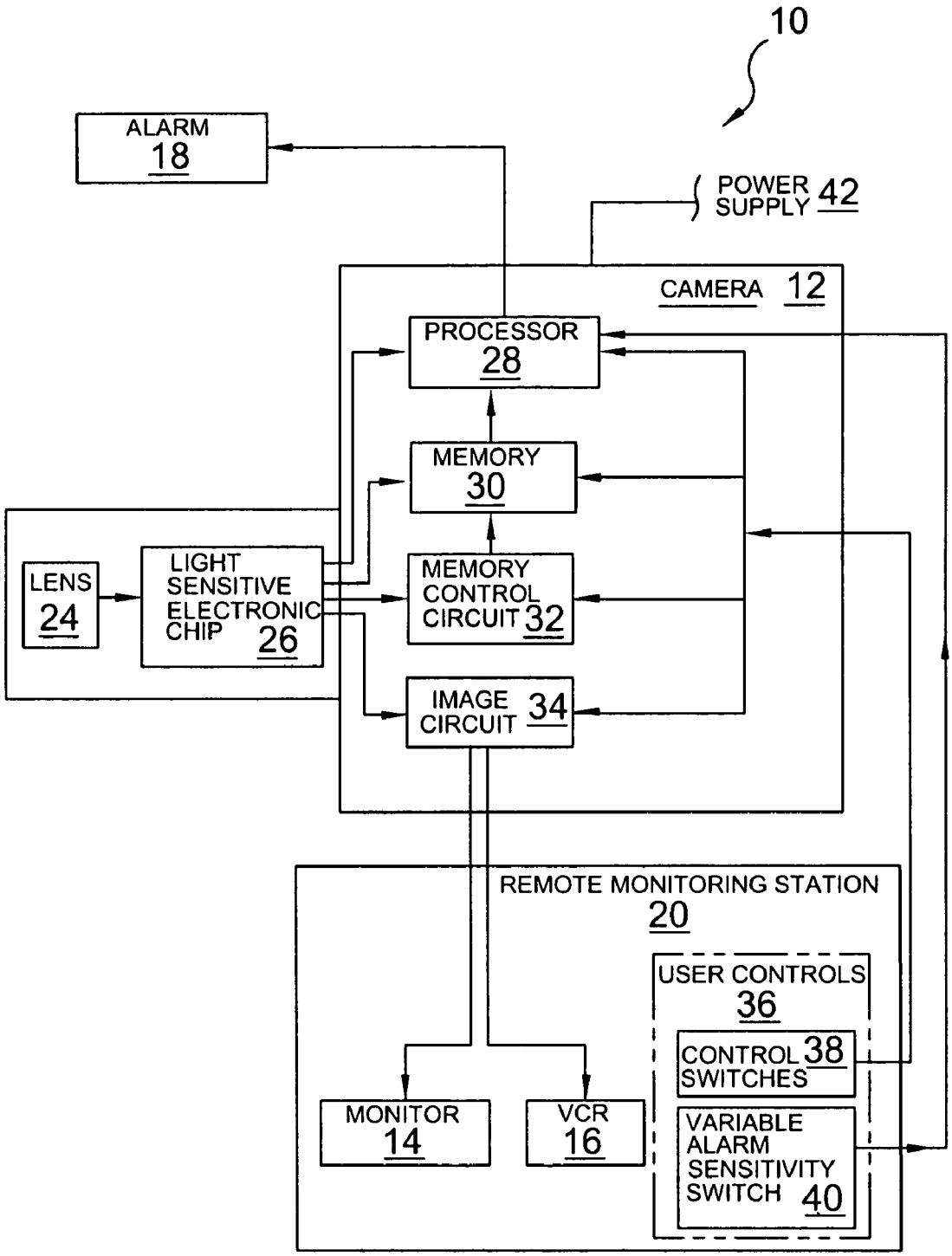
FIG. 2 is a block diagram of the present invention.

FIG. 2 is an illustrative block diagram of the present invention 10. The image data analysis security camera system 10 of the present invention comprises components that are readily available, inexpensive and easily installed without the need for motion detectors, lasers, heat sensors, electrical contacts on doors and windows, or audio sensors. All of which would require a greater amount of effort to install, maintain and fund. The present invention 10 may also be used as a standard monitor wherein the transmitted image is viewable on the monitor 14 and recorded on a video recording device 16 but without involving the logic circuit in the event that there is authorized activity in the area being monitored. The data image analysis security camera 12 comprises a lens 24, a light sensitive electronic chip 26, a processor 28, a memory 30, a memory control circuit 32 and an image circuit 34. The image data analysis security camera 10 is in communication with an external power source 42 a monitor 14, an audible and/or visual alarm 18, a recording device 16, user controls 36 including control switches 38 and a variable alarm sensitivity switch 40 based in a remote monitoring station 20.

Figure 3:
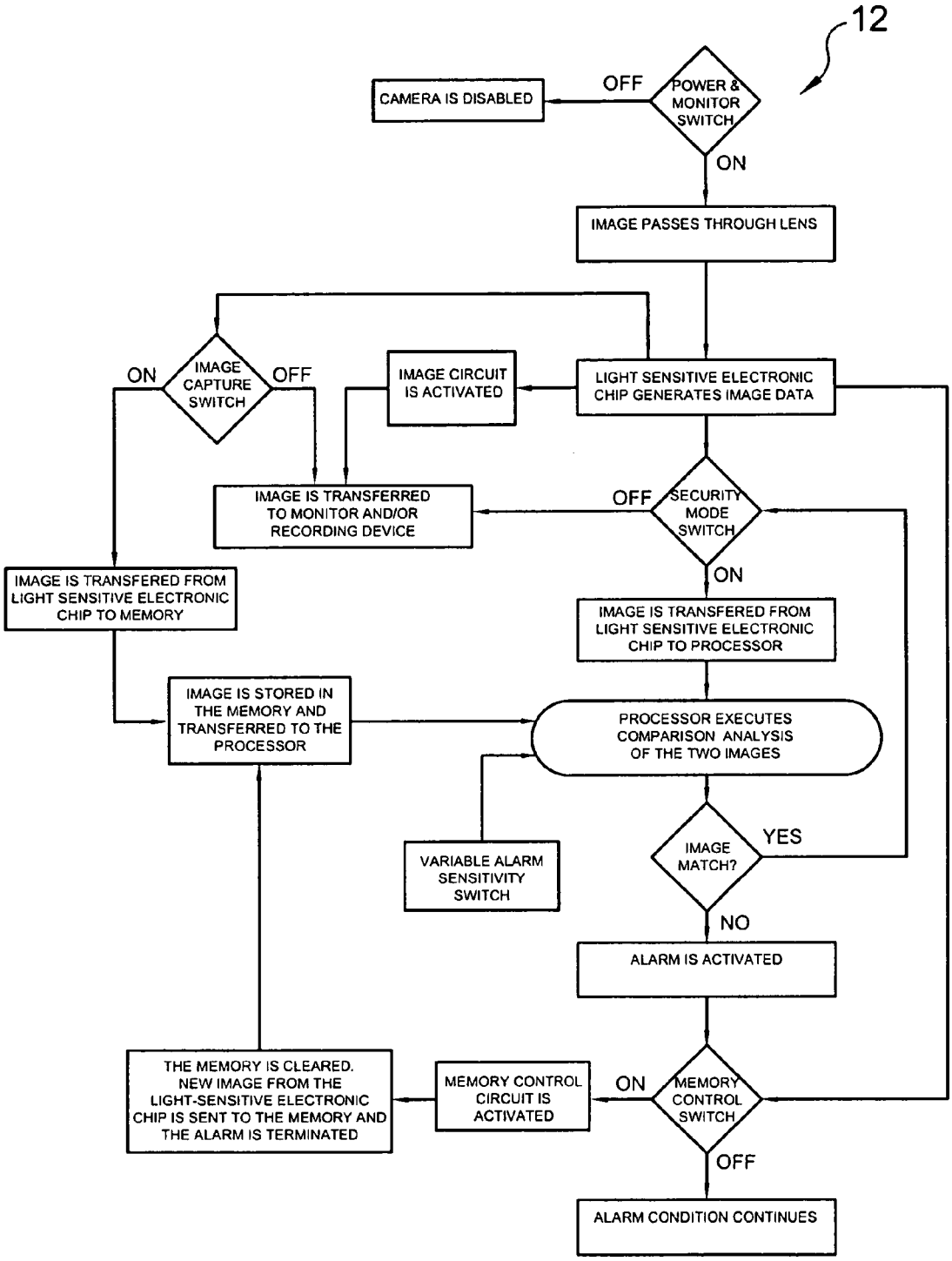
FIG. 3 is a flow chart of all operational phases of the image data analysis security camera of the present invention.

FIG. 3 is a flow chart of all operational work phases of the image data analysis security camera 12 of the present invention. Shown is a flow chart of the present invention demonstrating the process and inter-relationships of the various components.

Figure 4:
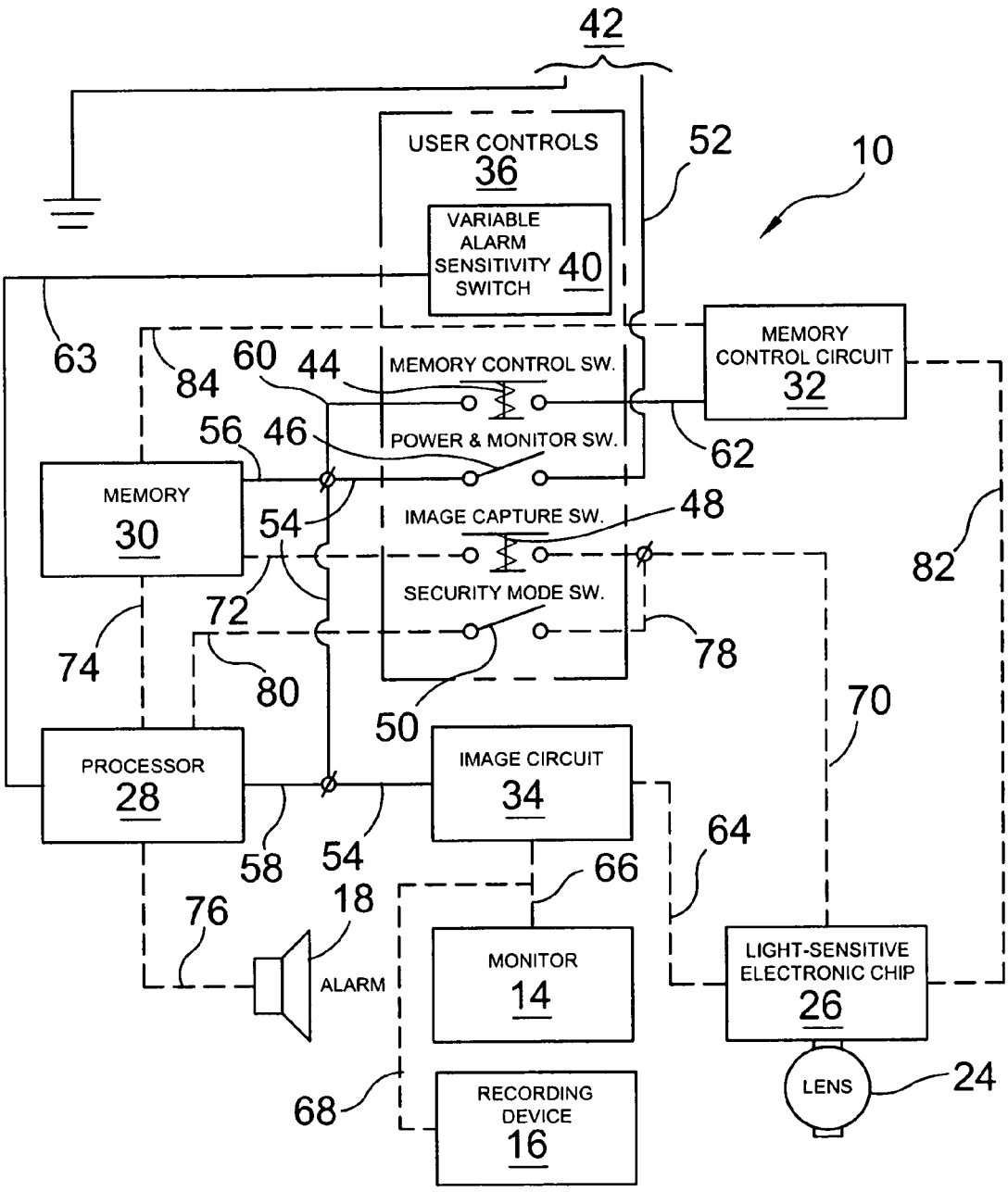
FIG. 4 is an interconnection diagram of the image data analysis security camera of the present invention.

FIG. 4 is a general overview interconnection diagram of the image data analysis security camera security system of the present invention 10. Shown are the primary components of the present invention 10 along their electrical connections, signal connections and various switches. The physical configuration of the present invention 10 may be varied without deviating from the intent and spirit of the present invention 10. The signal connections are depicted in dashed line and the current lines are shown in solid. Arrows indicate an active signal or current. The present invention 10 is off wherein the power and monitor switch 46 is open. The present invention 10 comprises a processor 28, a memory 30, a memory control circuit 32, an image circuit 34, a lens 24, a light-sensitive electronic chip 26, a monitor 14, a recording device 16, an alarm 18, a power source 42 and user controls 36 including a memory control switch 44, a power and monitor switch 46, an image capture switch 48, a security mode switch 50 and a variable alarm sensitivity switch 40. The circuit of the present invention 10 further includes a first electrical connection 52 running from the power source 42 to the power and monitor switch 46, a second electrical connection 54 connecting the power and monitor switch 46 to the image circuit 34, a third electrical connection 56 between the memory 30 and the second electrical connection 54, a fourth electrical connection 58 connecting the processor 28 to the second electrical connection 54, a fifth electrical connection 60 between the second electrical connection 54 and the memory control switch 44, a sixth electrical connection 62 between the memory control switch 44 and the memory control circuit 32, a control connection 63 communicating between the variable alarm sensitivity switch 40 and the processor 28, a first signal connection 64 running from the light-sensitive-electronic chip 26 to the image circuit 34, a second signal connection 66 between the image circuit 34 to the monitor 14, a third signal connection 68 connecting the recording device 16 to the second signal connection 66, a fourth signal connection 70 between the light sensitive electronic switch 26 and the image capture switch 48, a fifth signal connection 72 running from the image capture switch 48 to the memory 30, a sixth signal connection 74 from the memory 30 to the processor 28, a seventh signal connection 76 from the processor 28 to the alarm 18, an eighth signal connection 78 connecting the security mode switch 50 to the fourth signal connection 70, a ninth signal connection 80 from the security mode switch 50 to the processor 28, a tenth signal connection 82 from the light sensitive electronic chip 26 to the memory control circuit 32 and an eleventh signal connection 84 from the memory control circuit 32 to the memory 30.

Figure 5:
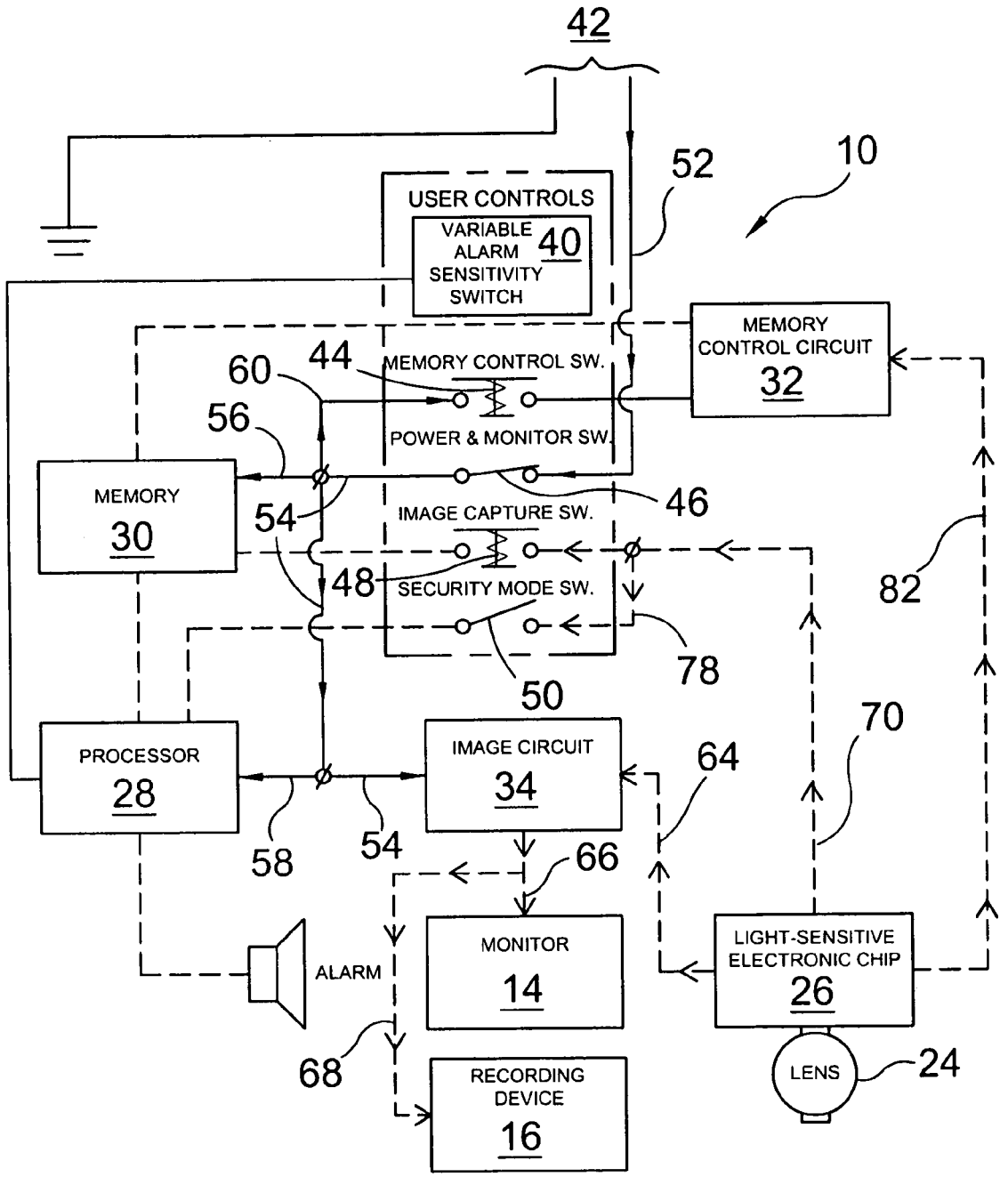
FIG. 5 is a general overview interconnection diagram of the image data analysis security camera of the present invention in monitor mode.

FIG. 5 is an interconnection diagram of the image data analysis security camera system of the present invention 10 in monitoring mode. The present invention 10 is in the monitor mode wherein the power and monitor switch 46 is closed and delivering current for all components thereby activating the image circuit 34 which transmits the signal viewed by the lens 24 and the light sensitive electronic chip 26 to the monitor 14 and the video recorder 16. Current travels from the power source 42 along the first electrical connection 52 to the closed power and monitor switch 46 along the second electrical connection 54 to the image circuit 34. Current also travels from the second electrical connection 54 through the fourth electrical connection 58 to the processor 28 which in not processing at this point, through the third electrical connection 56 to the memory 30 which is empty and through the fifth electrical connection 60 to the open memory control switch 44. The image signal is transferred along the first signal connection 64 to the image circuit 34, along the second signal connection 66 to the monitor 14 and from the second signal connection 66 along the third signal connection 68 to the recording device 16. The image signal simultaneously travels from the light-sensitive electronic chip 26 along the fourth signal connection 70 to the open image capture switch 48 and from the fourth signal connection 70 along the eighth signal connection 78 to the open security mode switch 50. The image signal is also transmitted from the light-sensitive electronic chip 26 along the tenth signal connection 82 to the memory control circuit 32 which remains inactive until a current is applied thereto.

Figure 6:
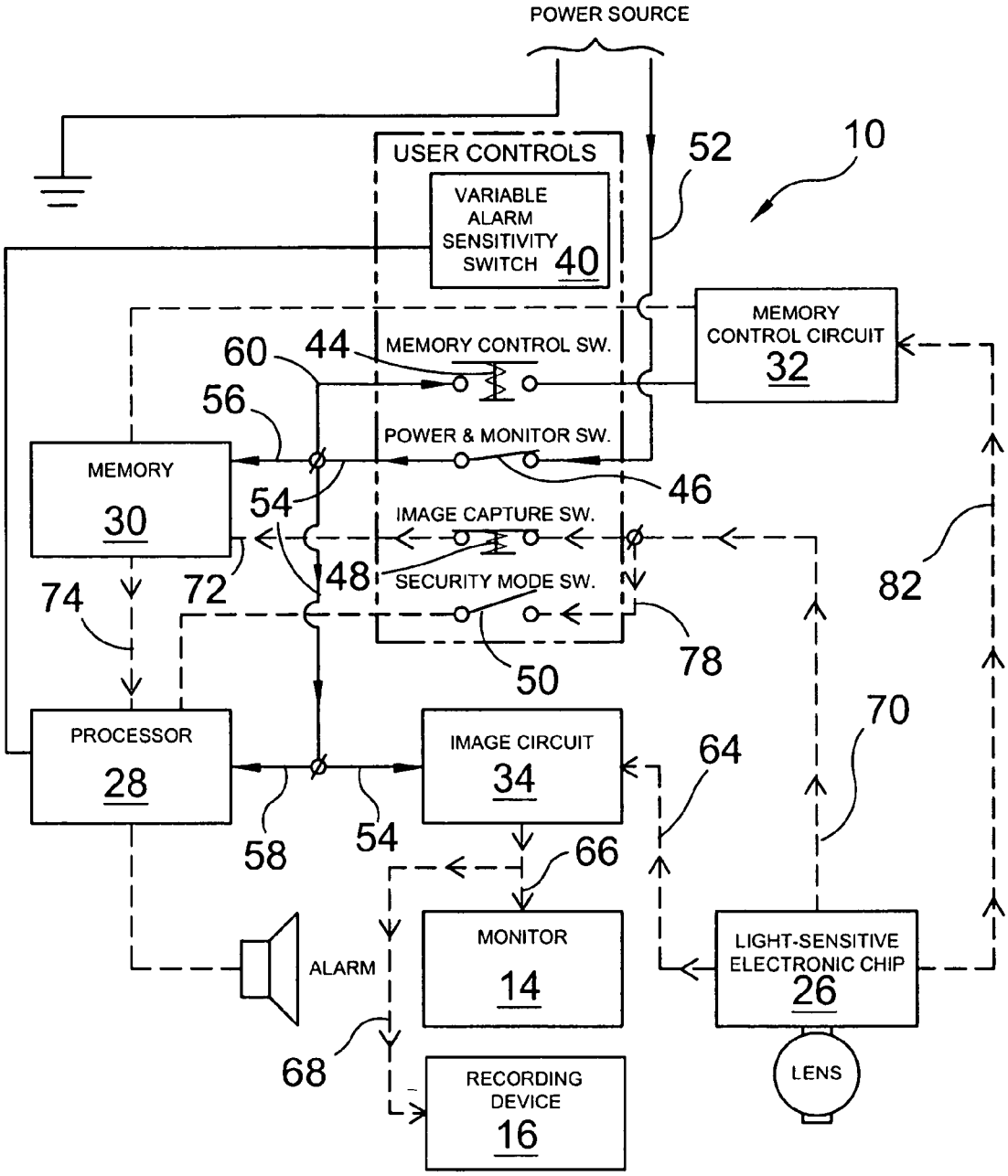
FIG. 6 is an interconnection diagram of the image data analysis security camera of the present invention in image capture mode.

FIG. 6 is an interconnection diagram of the image data analysis security camera system of the present invention 10 in image capture mode. The image capture switch 48 is a contact switch that is momentarily closed allowing the image signal to travel from the light-sensitive electronic chip 26 to the memory 30 where the image is stored and read by the processor 28. The processor 28 will not process until it receives two signals, one from the memory 30 and one from the electronic chip 26 via a closed security mode switch 48 which is open during the image capture stage. The image capture switch 48 is a contact switch that opens when released by the operator. Current travels along the first electrical connection 52 to the closed power and monitor switch 46 along the second electrical connection 54 to the image circuit 34. Current also travels from the second electrical connection 54 through the fourth electrical connection 58 to the processor 28, through the third electrical connection 56 to the memory 30 through the sixth signal connection 74 to the processor 28 and through the fifth electrical connection 60 to the open memory control switch 44. The image signal is transferred along the first signal connection 64 to the image circuit 34, along the second signal connection 66 to the monitor 14 and from the second signal connection 66 along the third signal connection 68 to the recording device 16. The image signal simultaneously travels from the light-sensitive electronic chip 26 along the fourth signal connection 70 to the closed image capture switch 48 and along the fifth signal connection 72 to the memory 30 and from the fourth signal connection 70 along the eighth signal connection 78 to the open security mode switch 50. The image signal is also transmitted from the light-sensitive electronic chip 26 along the tenth signal connection 82 to the memory control circuit 32 which is not operating.

Figure 7:
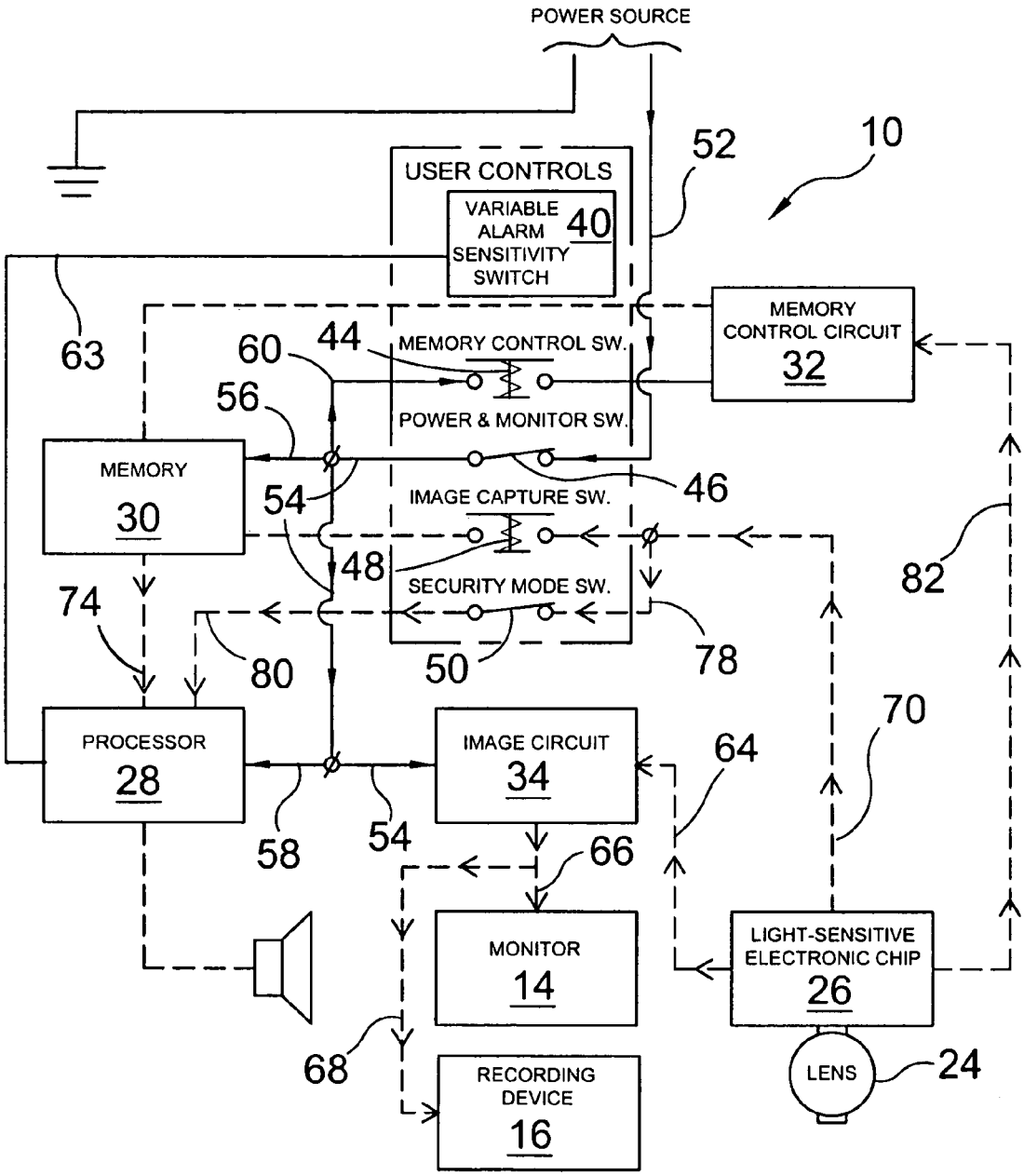
FIG. 7 is an interconnection diagram of the image data analysis security camera of the present invention in security mode.

FIG. 7 is an interconnection diagram of the image data analysis security camera system of the present invention 10 in security mode. Shown is the present invention 10 in the security mode wherein the image capture switch 48 has been released and is open and the security mode switch 50 is closed thereby transmitting the image viewed by the lens 24 from the electronic chip 26 to the processor 28 which is now processing and comparing the captured image from the memory 30 with each subsequent image received from the electronic chip 26. Prior to processing the variable sensitivity switch 40 is adjusted by the user to inform the processor 28 through the control connection 63 how great a degree of deviation is desired to initiate an alarm condition. Current travels along the first electrical connection 52 to the closed power and monitor switch 46 along the second electrical connection 54 to the image circuit 34. Current also travels from the second electrical connection 54 through the fourth electrical connection 58 to the processor 28, through the third electrical connection 56 to the memory 30 and through the fifth electrical connection 60 to the open memory control switch 44. The image signal is transferred along the first signal connection 64 to the image circuit 34, along the second signal connection 66 to the monitor 14 and from the second signal connection 66 along the third signal connection 68 to the recording device 16. The image signal simultaneously travels from the light-sensitive electronic chip 26 along the fourth signal connection 70 to the open image capture switch 48 and from the fourth signal connection 70 along the eighth signal connection 78 to the closed security mode switch 50 and along the ninth signal connection 80 to the processor 28. The image signal is also transmitted from the light-sensitive electronic chip 26 along the tenth signal connection 82 to the memory control circuit 32 which is inactive. The captured image in the memory 30 is read by the processor 28 over the sixth signal connection 74.

Figure 8:
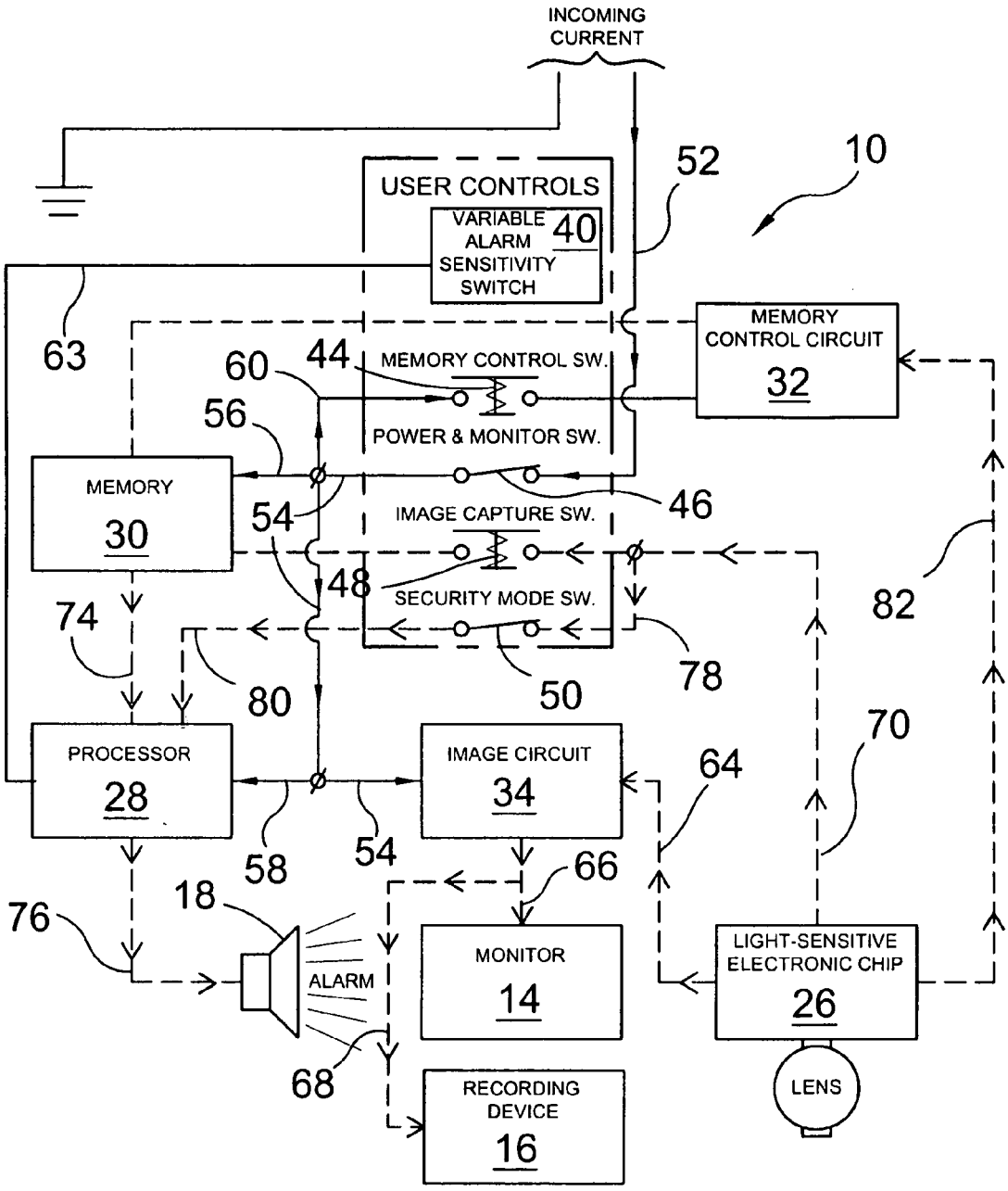
FIG. 8 is an interconnection diagram of the image data analysis security camera of the present invention in alarm mode.

FIG. 8 is an interconnection diagram of the image data analysis security camera system of the present invention 10 in alarm mode. Shown is the present invention 10 in the alarm stage wherein the processor 28 has detected a discrepancy between the image stored in the memory 30 and the image transmitted from the electronic chip 26 and has responded by sending a signal to activate the alarm 18. The present invention 10 remains in an alarm state until the memory control switch 44 is closed to overwrite the stored image in the memory 30 with the current image sent from the light sensitive electronic chip 26. Current travels along the first electrical connection 52 to the closed power and monitor switch 46 along the second electrical connection 54 to the image circuit 34. Current also travels from the second electrical connection 54 through the fourth electrical connection 58 to the processor 28, through the third electrical connection 56 to the memory 30 and through the fifth electrical connection 60 to the open memory control switch 44. The image signal is transferred along the first signal connection 64 to the image circuit 34, along the second signal connection 66 to the monitor 14 and from the second signal connection 66 along the third signal connection 68 to the recording device 16. The image signal simultaneously travels from the light-sensitive electronic chip 26 along the fourth signal connection 70 to the open image capture switch 48 and from the fourth signal connection 70 along the eighth signal connection 78 to the closed security mode switch 50 and along the ninth signal connection 80 to the processor 28. The image signal is also transmitted from the light-sensitive electronic chip 26 along the tenth signal connection 82 to the memory control circuit 32 which is not working. The captured image in the memory 30 is sent to the processor 28 over the sixth signal connection 74. A signal is sent from the processor 28 over the seventh signal connection 76 to activate the alarm 18. The processor 28 and the variable alarm sensitivity switch 40 communicate via the control connection 63.

Figure 9:
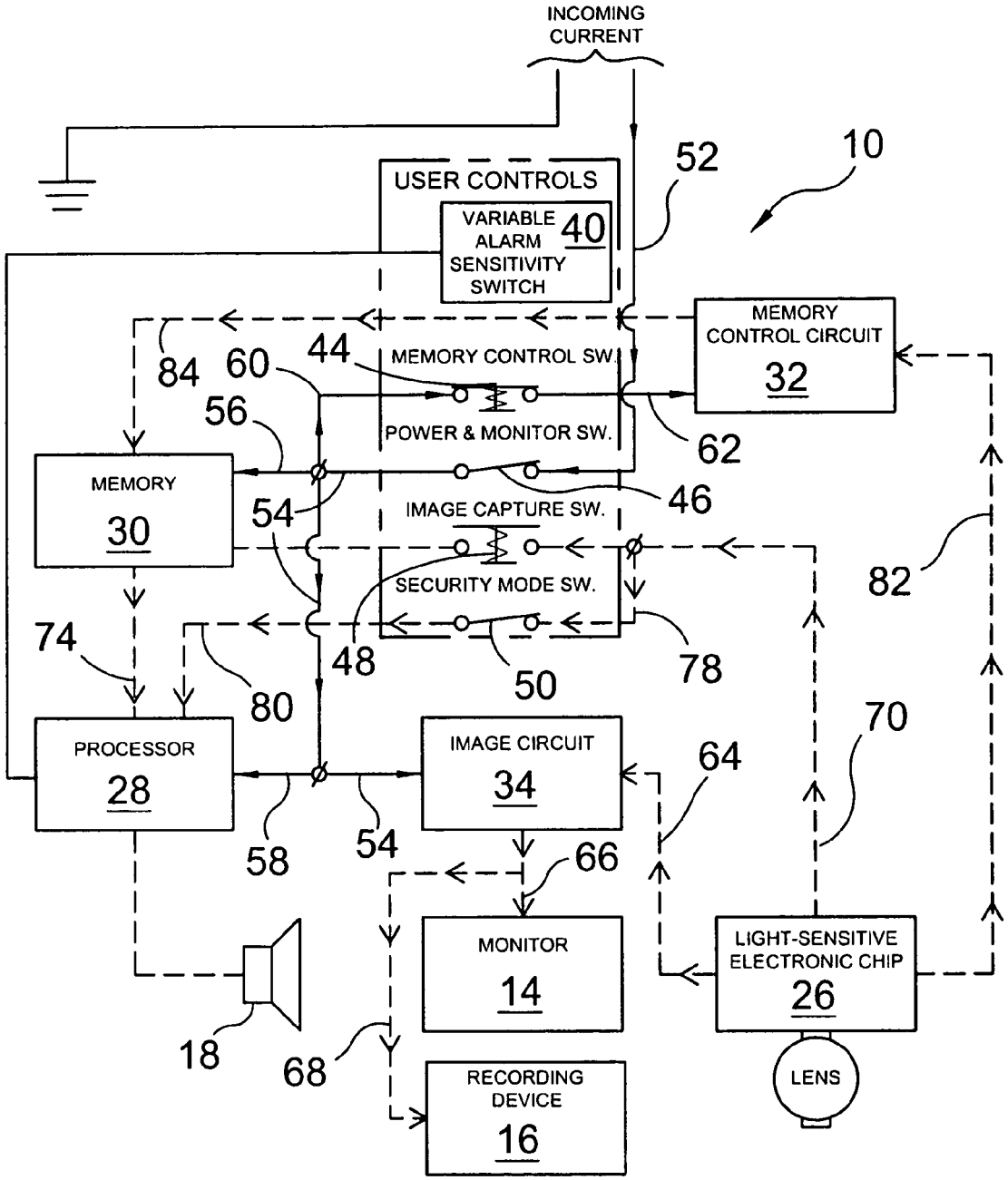
FIG. 9 is an interconnection diagram of the image data analysis security camera of the present invention in reset mode.

FIG. 9 is an interconnection diagram of the image data analysis security camera system of the present invention 10 in reset mode. Shown is the present invention 10 in the reset stage wherein the memory control switch 44 is closed thereby activating the memory control circuit 32 which transfers an image signal from the electronic chip 26 to the memory 30 which then overwrites the previous captured image with the current one to achieve equilibrium between the captured image and the real time image thereby causing the processor 28 to stop the alarm 18 and return to security mode. The memory control switch 44 is also a contact switch which opens immediately after closing the circuit. Current travels along the first electrical connection 52 to the closed power and monitor switch 46 along the second electrical connection 54 to the image circuit 34. Current also travels from the second electrical connection 54 through the fourth electrical connection 58 to the processor 28, through the third electrical connection 56 to the memory 30 and through the fifth electrical connection 60 to the closed memory control switch 44 over the sixth electrical connection 62 to activate the memory control circuit 32. The image signal is transferred along the first signal connection 64 to the image circuit 34, along the second signal connection 66 to the monitor 14 and from the second signal connection 66 along the third signal connection 68 to the recording device 16. The image signal simultaneously travels from the light-sensitive electronic chip 26 along the fourth signal connection 70 to the open image capture switch 48 and from the fourth signal connection 70 along the eighth signal connection 78 to the closed security mode switch 50 along the ninth signal connection 80 to the processor 28. The image signal is also transmitted from the light-sensitive electronic chip 26 along the tenth signal connection 82 to the memory control circuit 32 and along the eleventh signal connection 84 to the memory 30 then through the sixth signal connection 74 to the processor 28. With this, we overwrite the previous captured image with the current one thereby completing the reset process.

Figure 10:
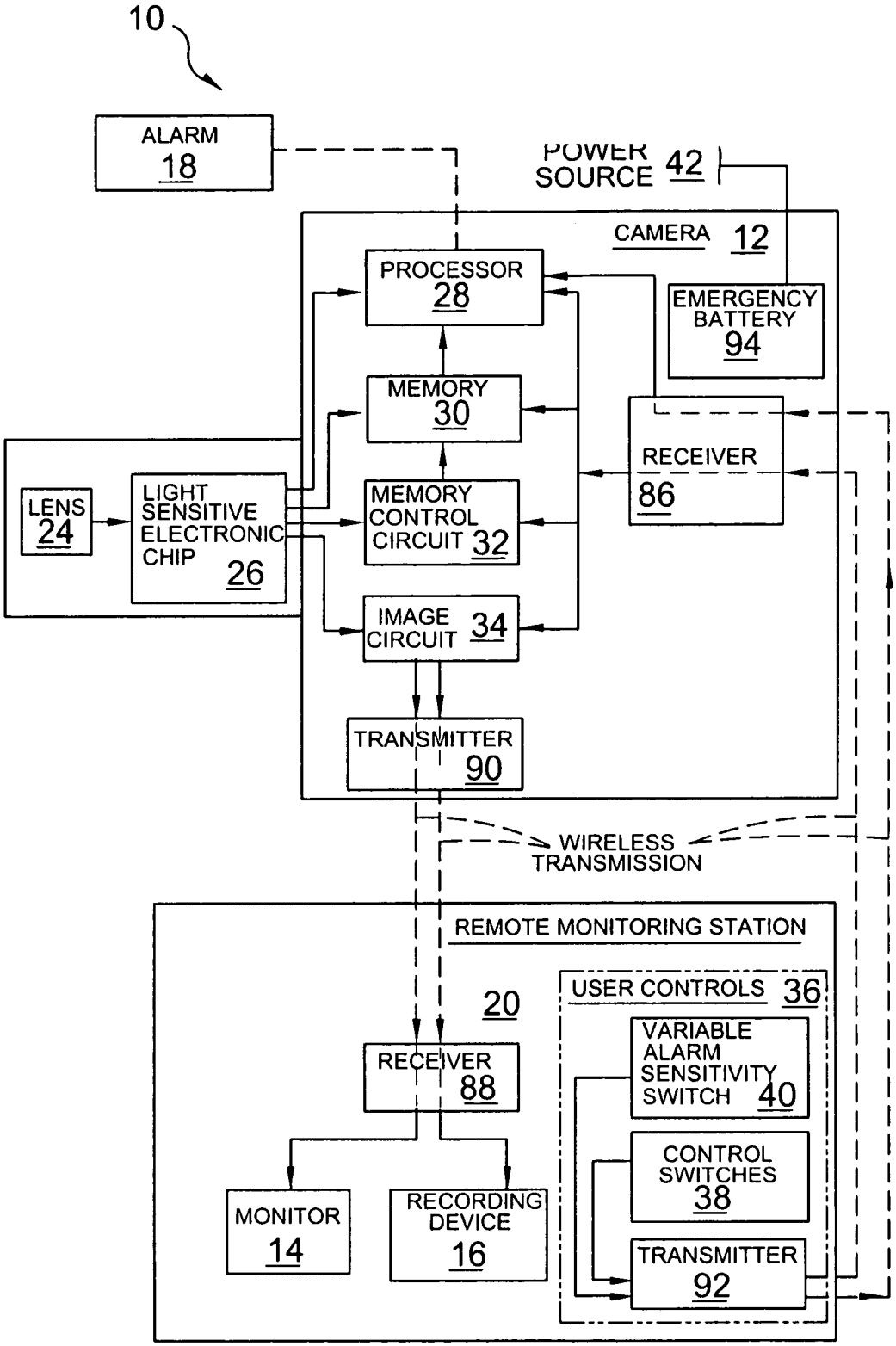
FIG. 10 is an interconnection diagram of the image data analysis security camera of the present invention with additional elements.

FIG. 10 is an interconnection diagram of the image data analysis security camera system of the present invention 10 with additional elements. Shown is the security system 10 with an additional element comprising connection less communications. To suit user requirements, connection less communication may be utilized between select components or the complete security system. This additional element provides improved means for setup and transportability. The camera 12 comprises a lens 24 a light-sensitive electronic chip 26, a processor 28, a memory 30, a memory control circuit 32 an image circuit 34, a transmitter 90, a receiver 86 and a battery 94. The camera 12 is in communication with a remote alarm 18. The emergency battery 94 serves to provide a back-power source in the event that the external power source 42 is compromised. The termination of electricity from the external power source 42 will automatically transfer power distribution to the emergency battery 94 thereby assuring the continuous operation of the present invention 10 until the external power is restored. The remote monitoring station 20 comprises user controls 36 including control switches 38, a variable alarm sensitivity switch 40, a transmitter 32, a recording device 16, a monitor 14 and a receiver 88.

Figure 11:
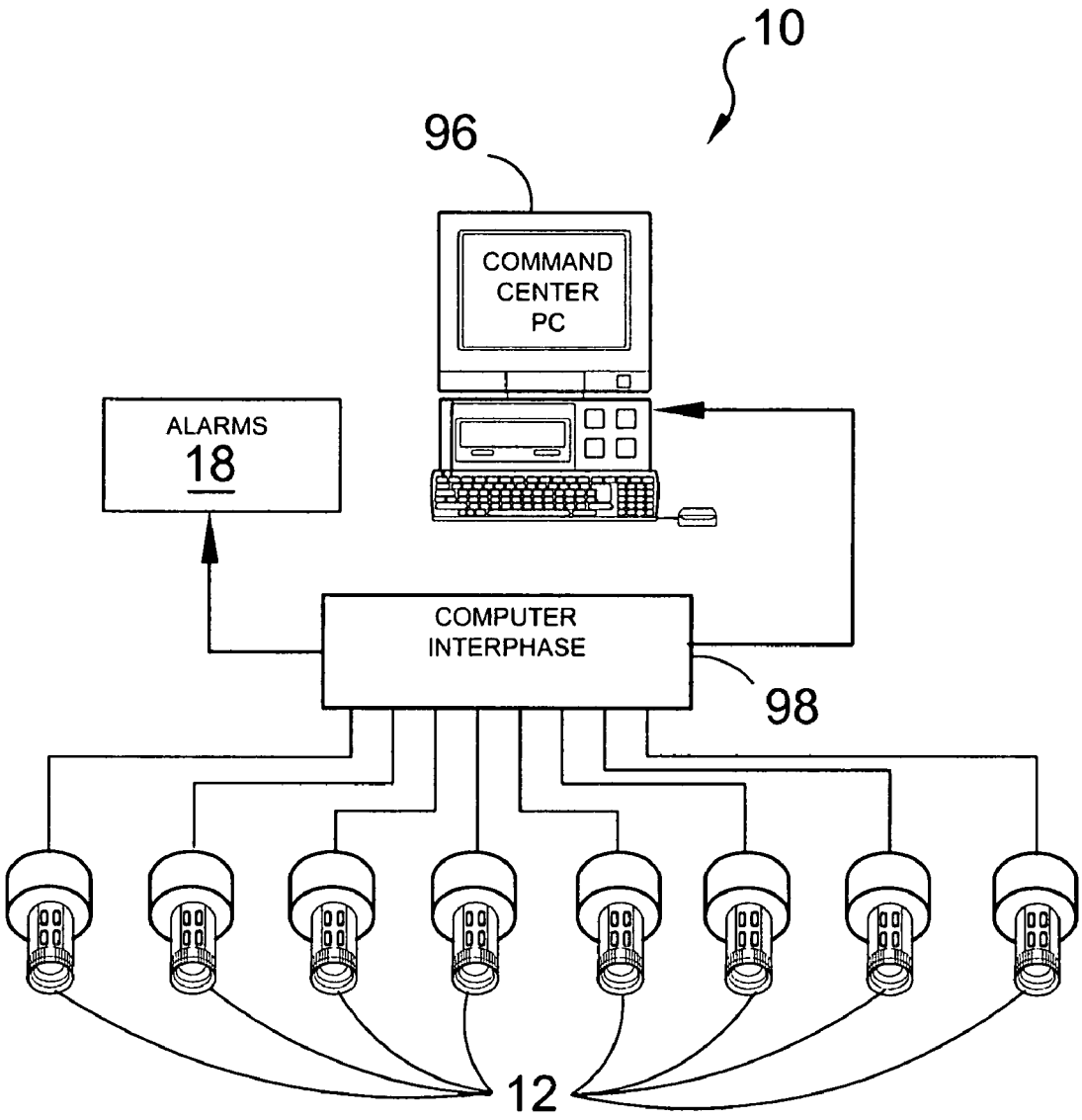
FIG. 11 is an illustrative view wherein a plurality of image data analysis security cameras is in use with a single computer.

FIG. 11 is an illustrative view wherein a plurality of image data analysis security cameras 12 is in use with a single computer 96. The present invention 10 may easily be adapted for multiple cameras 12 to simultaneously be in use with a single system. Shown is a configuration wherein the cameras 12 are in communication with a computer interface 98 that routes the appropriate signals to the computer 96 and, if necessary, to the pertinent alarms 18. Keystrokes may be used by the operator to switch between cameras 12 for manual monitoring and to activate the control switches.

Figure 12:
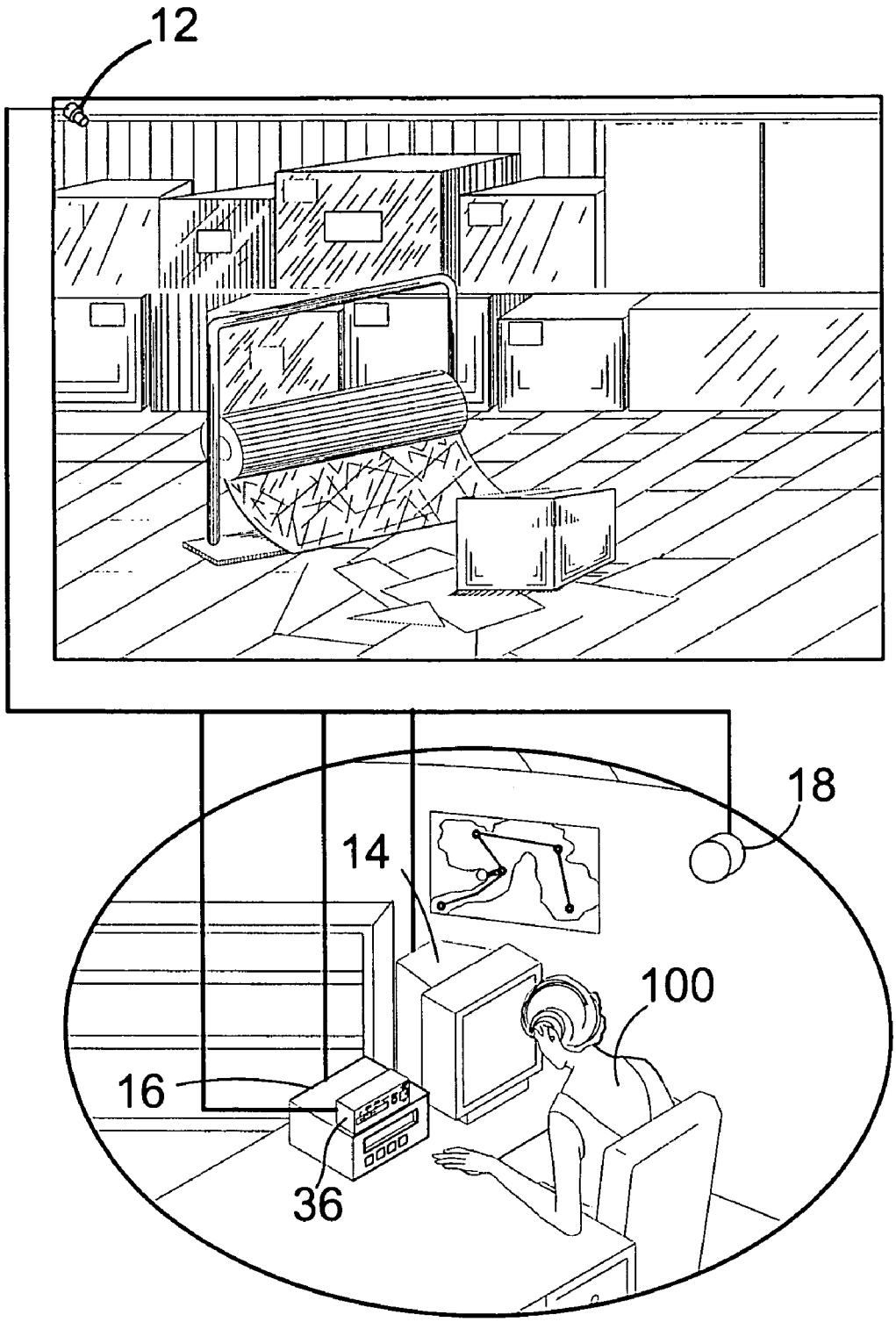
FIG. 12 is an illustrative view of the present invention in use in security mode.

FIG. 12 is an illustrative view of the present invention in use. Shown is the image data analysis security camera system of the present invention in use wherein the camera 12 is installed in a secure area. The camera 12 may be set in monitor mode wherein the image is sent directly to the monitor 14 and the recording device 16 or the operator 100 may capture an image thereby initiating the security mode wherein subsequent images are compared thereto. An alarm 18 will be activated if a deviation between the real time image and the sampled image stored in the memory is detected by the processor. The operator 100 determines the operation and function of the present invention from a remote location through the manipulation of user controls 36.

Figure 13:
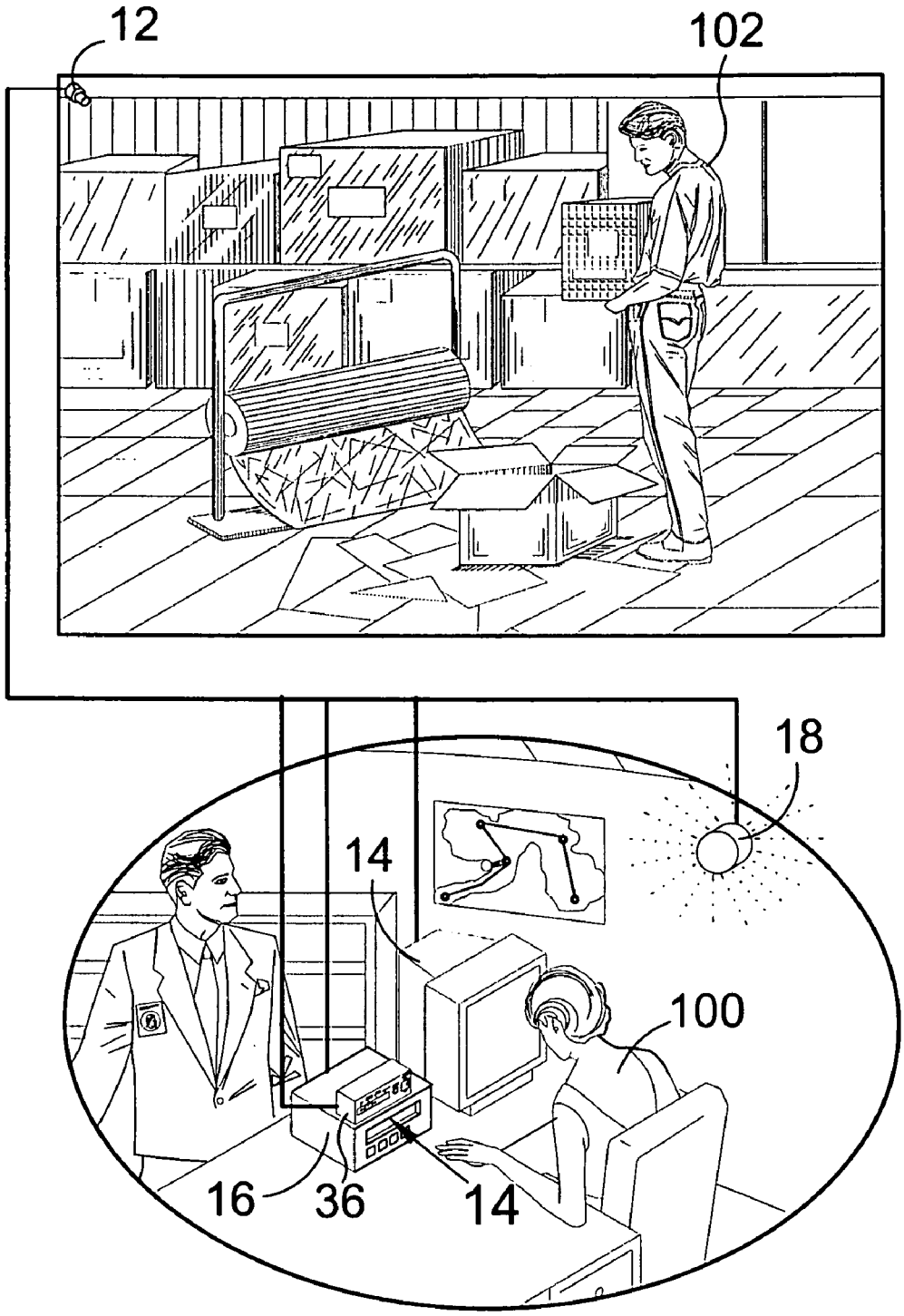
FIG. 13 is an illustrative view of the present invention in use in alarm mode.

FIG. 13 is an illustrative view of the present invention in use. Shown is the image data analysis security camera system of the present invention in use wherein the processor in the camera 12 has detected an image differentiation between the real time image and the captured image because an intruder 102 has entered the secured area and has initiated the alarm mode. An audible/visual alarm 18 has been activated and has alerted security personnel to the breach of the secured area. The image of the secured area is being transmitted to the monitor 14 and recording device 16 in the remote monitoring station. The present invention will remain in alarm mode until the operator 100 presses the memory control switch on the user controls 36 to clear the previously captured image and replace it with the current one thus returning the system to security mode.

Figure 14:
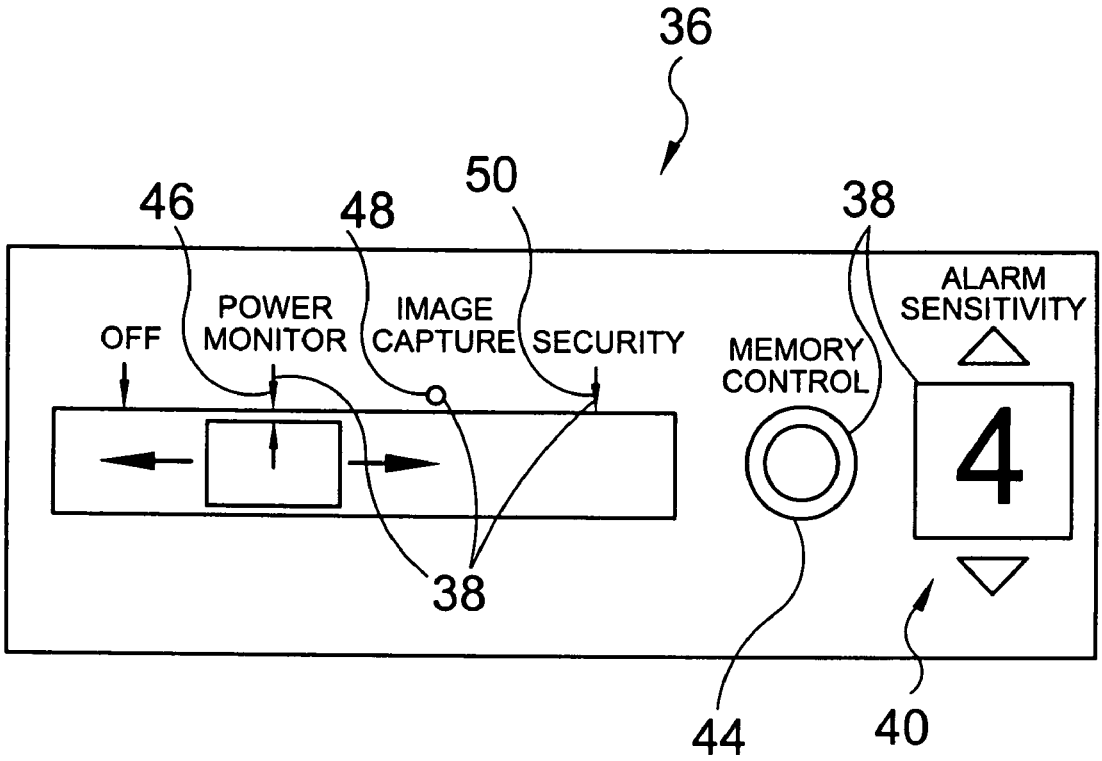
FIG. 14 is an illustrative view of the control switches of the present invention.

FIG. 14 is an illustrative view of the user controls 36 including control switches 38. The control switches 38 of the present invention are designed to be positioned and operated at the monitoring station. The switches 38 include a power and monitor switch 46, an security mode switch 50, an image capture switch 48, a memory control switch 44 and an variable alarm sensitivity switch 40. The variable alarm sensitivity switch 40 serves to allow the operator to adjust the degree of differentiation required to initiate the alarm mode. This is achieved through the use of a variable resistor or other such appropriate component suitable for the objective of the variable alarm sensitivity switch 40. The variable alarm sensitivity switch 40 informs the processor how great a deviation between the captured image and the real time image is required to initiate an alarm condition.

Figure 15:
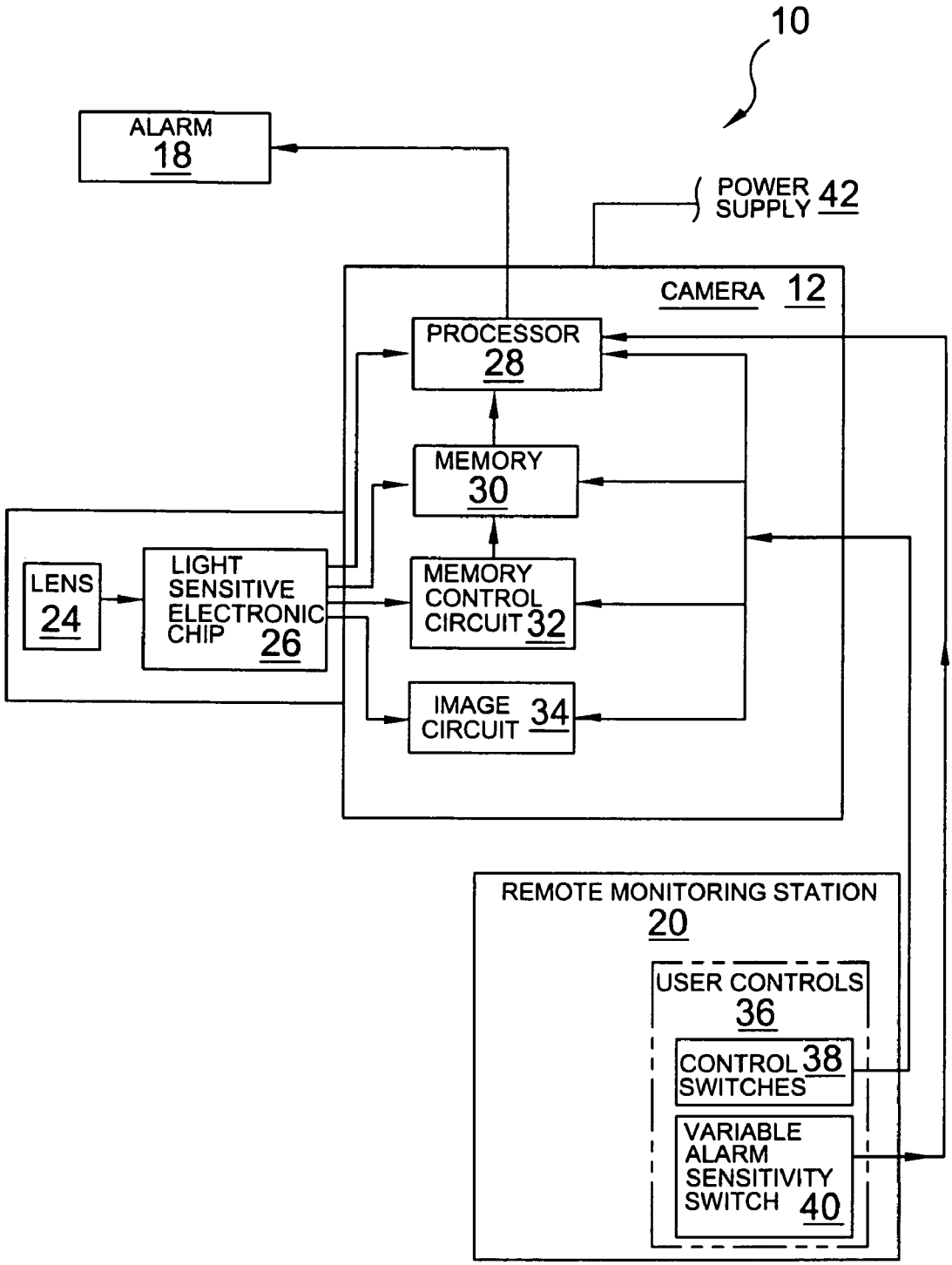
FIG. 15 is a block diagram of the present invention transmitting to an alarm only.

FIG. 15 is an illustrative block diagram of the present invention 10. The data image analysis security camera 12 of the present invention 10 may also be used with just an alarm 18 without a link to a monitor or a recording device. The data image analysis security camera 12 comprises a lens 24, a light sensitive electronic chip 26, a processor 28, a memory 30, a memory control circuit 32 and an image circuit 34. The image data analysis security camera 12 is in communication with an external power source 42, an audible and/or visual alarm 18, user controls 36 including control switches 38 and a variable alarm sensitivity switch 40 based in a remote monitoring station 20.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. An image data analysis security camera comprising:

a) means for scanning a selected field of view;

b) means for converting the scanned image field into electrical signals and distributing said image signals;

c) an image circuit for transferring said image signals to a remote location;

d) memory means for sampling and storing an initial image delivered from said image conversion means;

e) a processor for comparing said sampled image in said memory with subsequent real time images delivered from said image conversion means;

f) user controls disposed at a remote location to allow an operator to control the function and operation of said image data analysis camera;

g) a power source; and h) an alarm disposed in a remote location in communication with said processor, wherein said user controls include a plurality of control switches comprising:

i) a power and monitor switch to turn on the camera and said power and monitor switch remains on during the operation of said image data analysis security camera and will turn it off when opened;

ii) a memory control switch to deliver current to said memory control circuit when closed, said memory control switch being a contact switch that is always open except while momentarily closed by the user to activate said memory control circuit in order to transfer the current image delivered from said light-sensitive electronic chip to said memory to overwrite the image stored therein and will return to the open position once released;

iii) a security mode switch in line between said light-sensitive electronic chip and said processor to deliver the current image from said light-sensitive electronic chip to said processor, said security mode switch remains closed for the duration of the security mode; and iv) an image capture switch in line between said light-sensitive electronic chip and said memory to transfer the current image from said light-sensitive electronic chip to said memory where it will be stored, said image capture switch being a contact switch that is always open except while momentarily closed by the user and will return to the open position once released.

2. An image data analysis security camera as recited in claim 1, wherein said image scanning means is a lens.

3. An image data analysis security camera as recited in claim 1, wherein said image conversion and distribution means is a light-sensitive electronic chip.

4. An image data analysis security camera as recited in claim 1, wherein said memory means comprises:

a) a memory chip for storing said sampled image; and b) a memory control circuit to reset said memory and overwrite said sampled image with a current image.

5. An image data analysis security camera as recited in claim 1, wherein said user controls further include an variable alarm sensitivity switch in communication with said processor to allow the user to adjust the degree of deviation between the sampled image and the subsequent images required to activate said remote alarm.

6. An image data analysis security camera as recited in claim 1, wherein said image circuit transfers real time streaming video to a monitor in a remote location.

7. An image data analysis security camera as recited in claim 1, wherein said image circuit transfers real time streaming video to a recording device in a remote location.

8. An image data analysis security camera as recited in claim 1, wherein said camera is turned on from a remote location when the user closes said power and monitor switch thereby energizing said image circuit which reads the image signal from said light-sensitive electronic chip and transmits it to said monitor and said recording device thereby providing remote monitoring of the field of view of said lens.

9. An image data analysis security camera as recited in claim 1, wherein said camera is put into the image capture mode when said image capture switch is momentarily closed in order to send an image signal transmitted from said light-sensitive electronic chip to said memory for delivery to said processor for comparison with subsequent images received from said light-sensitive electronic chip when placed in security mode.

10. An image data analysis security camera as recited in claim 1, wherein said processor is constantly comparing subsequent images transmitted from said light-sensitive electronic chip with said sample image in said memory while in security mode, said alarm is activated if a deviation is detected between the two images that exceeds the degree of deviation as determined by said variable alarm sensitivity switch.

11. An image data analysis security camera as recited in claim 1, wherein said alarm is disabled when in alarm mode by the operator closing said memory control switch thereby energizing said memory control circuit which transmits the current image from said light-sensitive electronic chip to said memory where it overwrites the previously captured image, said processor then detects no deviation between the newly stored image in said memory and the subsequent images sent from said light-sensitive electronic chip and deactivates said alarm thereby returning to security mode.

12. An image data analysis security camera as recited in claim 1, wherein said power source is external.

13. An image data analysis security camera as recited in claim 12, wherein said power source is low voltage.

14. An image data analysis security camera as recited in claim 1, wherein said power source is an internal battery.

15. An image data analysis security camera as recited in claim 1, that can be connected to a computer interphase that enable a plurality of image data analysis cameras to be linked to a computer and the user controls of each camera can be accessed by keystrokes.

16. An image data security analysis camera as recited in claim 1, wherein said camera has wireless communication capabilities with said user controls, said monitor, said recording device and said alarm.

17. An image data analysis security camera as recited in claim 9, wherein said memory is cleared once the power and monitor switch is opened thereby turning off said camera.

18. An image data analysis security camera as recited in claim 1, wherein said image data analysis camera can be in communication with said alarm and said user controls without a link-up to a monitor or recording device.

* * * * *